US011098522B1

(12) United States Patent
Fugate et al.

(10) Patent No.: US 11,098,522 B1
(45) Date of Patent: Aug. 24, 2021

(54) SOLID TRANSPARENT HEALTH GATE

(71) Applicants: Brett Fugate, Washington, IL (US); Edward Christian Arnold, East Peoria, IL (US)

(72) Inventors: Brett Fugate, Washington, IL (US); Edward Christian Arnold, East Peoria, IL (US)

( * ) Notice: Subject to any disclaimer, the term of this patent is extended or adjusted under 35 U.S.C. 154(b) by 0 days.

(21) Appl. No.: 17/015,229

(22) Filed: Sep. 9, 2020

Related U.S. Application Data

(60) Provisional application No. 63/023,643, filed on May 12, 2020.

(51) Int. Cl.
*E06B 5/10* (2006.01)
*E06B 7/28* (2006.01)

(52) U.S. Cl.
CPC . *E06B 5/10* (2013.01); *E06B 7/28* (2013.01)

(58) Field of Classification Search
CPC ..... E06B 5/10; E06B 7/28
USPC ..... 52/202, 203; 49/67, 65, 63, 62, 61
See application file for complete search history.

(56) References Cited

U.S. PATENT DOCUMENTS 1,415,854 A * 5/1922 Abramson ..... E06B 5/00 160/96
1,686,819 A * 10/1928 Kirschbaum ..... E06B 5/00 160/96
4,302,907 A * 12/1981 Canals ..... E05C 7/02 292/150
4,389,817 A * 6/1983 Olberding ..... E05B 47/0002 49/163
4,891,906 A * 1/1990 Knapp ..... E05C 7/02 49/62
5,535,550 A * 7/1996 Yang ..... E05B 65/1053 292/92
6,109,328 A * 8/2000 Montana ..... E06B 9/52 160/92
6,941,997 B2 * 9/2005 Butler ..... E05C 7/02 160/92
9,228,386 B2 * 1/2016 Thielmann ..... F25D 23/10
10,233,669 B2 * 3/2019 Huang ..... E05B 65/087
10,378,236 B2 * 8/2019 Dershem ..... E04H 15/644
10,808,438 B2 * 10/2020 Takase ..... E05C 7/02
2009/0288614 A1 * 11/2009 Connot ..... A01K 1/0088 119/501
2016/0215544 A1 * 7/2016 Smalls ..... E05D 7/009
2017/0320380 A1 * 11/2017 Requa ..... B60J 5/0487
2018/0179780 A1 * 6/2018 Dershem ..... E04H 15/644
2018/0266175 A1 * 9/2018 York ..... E06B 3/88
2020/0002067 A1 * 1/2020 Dershem ..... F16G 11/14
2021/0025223 A1 * 1/2021 Hall ..... E06B 3/82

* cited by examiner

*Primary Examiner* — Brent W Herring
(74) *Attorney, Agent, or Firm* — Lesley A. Wallerstein, LLC

(57) ABSTRACT

We disclose methods of blocking the transmission of COVID-19 and other airborne pathogens between people standing on either side of a door separating an interior space from an exterior space. In a preferred embodiment, the method comprises hingedly mounting a rigid transparent gate directly to the door so that the gate swings independently of the door. Preferably, the gate is dimensioned to substantially fill the width defined by the frame holding the door. The method further comprises releasing the gate from a storage position against the door, coupling the gate to the door frame and opening the door.

3 Claims, 17 Drawing Sheets

SOLID TRANSPARENT HEALTH GATE

CROSS-REFERENCE TO RELATED APPLICATION (not applicable)

STATEMENT REGARDING FEDERALLY SPONSORED RESEARCH OR DEVELOPMENT (not applicable)

NAMES OF PARTIES TO A JOINT RESEARCH AGREEMENT (not applicable)

REFERENCE TO SEQUENCE LISTING, A TABLE OR A COMPUTER PROGRAM LISTING COMPACT DISC APPENDIX (not applicable)

FIELD OF THE INVENTION

This invention relates to the field of healthcare and personal hygiene.

BACKGROUND OF THE INVENTION

In the year 2019 a viral pandemic began known as COVID-19. COVID-19 is a virus that affects the respiratory system in *Homo sapiens*. As a result, society at large along with governmental suggestions began to incorporate countermeasures to this virus that focus on the prevention of person to person transmission of this virus. "Sheltering in place," "social distancing," awareness of personal hygiene, and of interactions with other people became the norm and the expectation for person to person interactions. As a result, people increasingly began consuming and/or hording items and resources such as hand sanitizer, food, face masks, cleaning supplies, and personal protective equipment (PPE). These products and resources became scarce or unavailable, creating a need for alternative, more innovative solutions to restore how we live our everyday lives.

Across the United States of America and the entire world, crafty people have been offering solutions to the scarcity of some of these items and resources. For instance, stay at home seamstresses create face masks from bandannas and coffee filters. Companies that produce alcoholic beverages such as whiskey have switched gears and pivoted into producing hand sanitizer. Countless brick and mortar retail outlets such as grocery stores and gas stations have made barriers from Plexiglas® or the like and mounted them to wooden stands or suspended them from the ceiling. This creates a barrier between the customer and the cashier that reduces the likelihood of a transmission of COVID-19.

Also, we have realized a marked change in the way that people consume items. Many businesses now offer "curbside" or "to the doorstep" delivery. The Internet today allows us purchase goods and services without face to face interaction, and from across a greater distance.

However, not all business can be transacted remotely. Not every person has the Internet or a smart phone. Some people prefer to pay with cash. We therefore need a solution that allows us to do business as interactively as possible while respecting social distancing.

We disclose a product that reduces the transmission of and exposure to airborne pathogens such as bacteria, viruses, and protists, while allowing face to face interaction. This includes but is not limited to the novel coronavirus responsible for causing COVID-19. A rigid transparent gate dimensioned to substantially fill the width defined by a door frame is hingedly mounted to a door already hanging within that frame. When the door is closed, the gate can be securely stored against the door by hook and loop or another selective fastener. When a visitor arrives, the door can be opened as usual. The gate can be detached from the door and secured to an opposing side of the door frame. By filling the door frame in this way, the gate blocks airborne pathogens, but allows the people to see each other. Preferably, the gate does not fill the entire area defined by the door frame. Instead, it will fill as much of the length defined by the door frame as necessary to block micro-organisms transmitted by speaking, breathing, coughing or sneezing, while still allowing them to physically exchange payment and product. We provide specific preferred materials dimensions under Detailed Description of the Invention, below. By hinging and securing the gate to the door in this way, the door and the gate can move together, or they can move independently.

The gate can be attached to any door that separates an interior space from an exterior space, regardless of the residential, commercial or other purpose of the space. The gate creates a physical barrier in any environment where two people need to stand on either side of a door opening. By way of example, and not meant to limit, this can be between a customer and merchant. It can also work between employees within a single office space. Ideally, it would be installed in doctor's offices, hospitals, and other environments having multiple rooms where disease is potentially present.

The gate can be mounted to a door facing an interior or an exterior space. It can be mounted to any door regardless of whether the door opens to the right or to the left. The gate has a length and at least one lengthwise edge. We mount to one lengthwise edge of the gate an edge hinge; the edge hinge runs along substantially that entire length of the gate. We mount the gate directly to the door, and specifically to the same side of the door (left or right) where the door itself is hinged to its frame, parallel to the door frame. The edge hinge includes leaves; the leaves of the edge hinge open 360 degrees, which allows the gate to freely open and close against the door, regardless to which side of the door the gate is mounted.

If the gate is mounted to face an exterior space, we augment and strengthen the means by which the hinge-free edge of the gate is secured against the door during storage. This is to prevent a sudden gust of wind or heavy rain from unintentionally separating the gate from the door. The gate of this invention may be used in conjunction with the outside door of a home or other building. The gate could work equally well in an office building, apartment building, shopping mall, or other large facility where an "exterior" door opens from an individual unit (office, apartment, store, restaurant, etc.) to a common area or hallway. In such situations the "exterior" is the common area or hallway shared by other offices, apartments, stores, or restaurants.

The prior art does not disclose any transparent gates which swing and can be secured independently of a door in the same opening. Our system allows the end user to easily and readily manipulate the gate so that the doorway is clear or blocked. This system can be used on any kind of door. It requires only a ruler, tape measure and simple screwdriver. We provide a template to assist with placement. The gate is removable and versatile.

REFERENCE NUMERALS

Figure 1A:
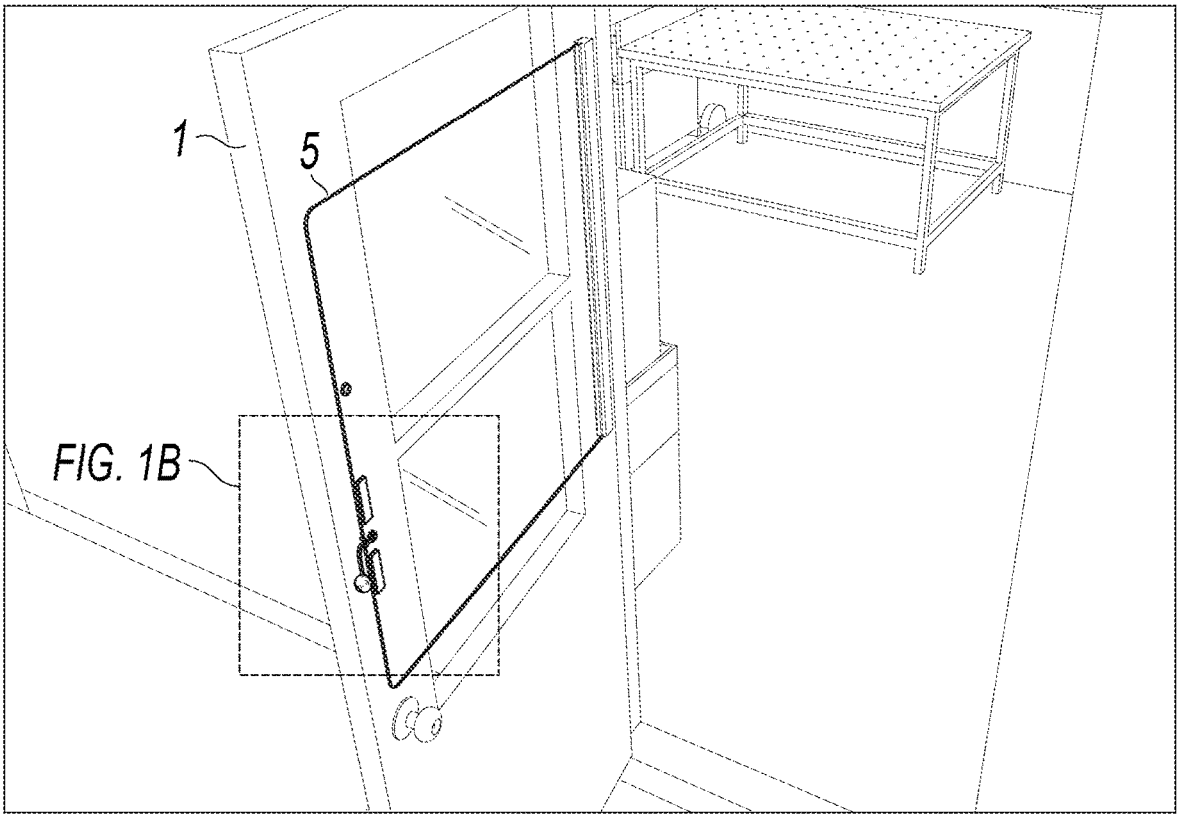
FIG. 1A is a perspective view of a solid transparent health gate in an interior installation and in a storage position, with its corresponding door open, as viewed from an exterior of the building.
Figure 1B:
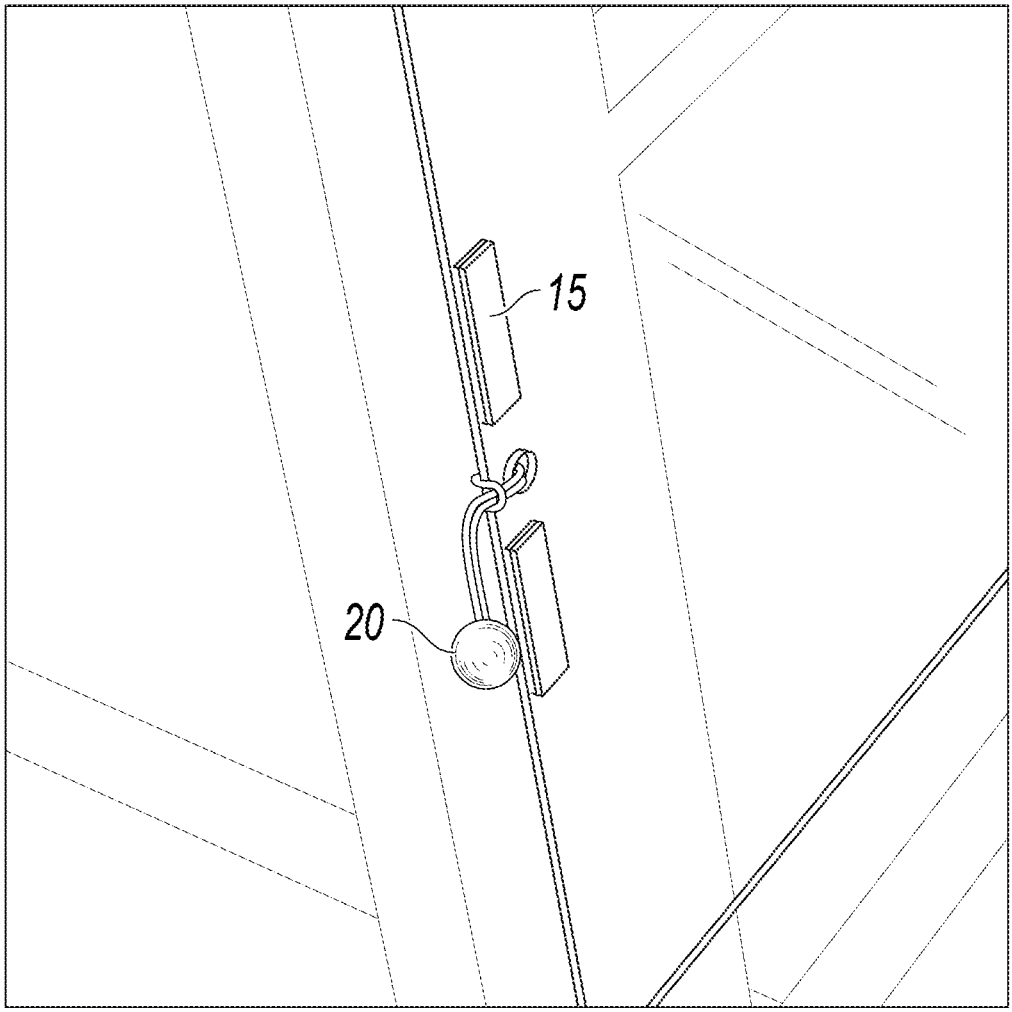
FIG. 1B is a close-up perspective view thereof, showing details of the bungee ball tie.

1. Door
5. Solid transparent health gate
10. Edge hinge
15. Hook and loop fastener
20. Bungee ball tie assembly
25. Receiving hook
30. Latch hinge
35. Pull-release latch assembly
40. Assembly fastener
45. Latch mounting strip
50. Hinge mounting strip
55. Gate cushion
60. Through holes
65. Latch cushion
70. Latch mounting block
75. Tee nut insert
80. Assembly fastener
85. Assembly tape
90. Assembly fastener

DETAILED DESCRIPTION OF THE INVENTION

The solid transparent health gate can be installed in a door frame facing an interior of a building or in a door frame facing an exterior of a building. FIGS. 1A-5 show the gate installed facing a building interior. FIGS. 6-10 show the gate installed facing a building exterior. FIGS. 1A-3B show various perspective views of an interior installation, in a storage position, with gate 5 closed and secured against corresponding door 1 which is open. Gate 5 comprises a rectangular sheet of transparent rigid thermoplastic, glass or acrylic glass. We prefer Lexan® brand polycarbonate resin and Plexiglas® brand acrylic. Gate 5 may optionally comprise transparent shatter resistant or impact resistant glass or thermoplastic may also be desirable. In some embodiments of the invention, the material of Gate 5 may be tinted or capable of polarizing light, or Gate 5 may comprise a tinted or polarizing layer or film. Gate 5 is dimensioned to substantially fill widthwise the area defined by the door frame, and span enough lengthwise to physically block the transmission of droplets people produce when they breathe, speak, cough or sneeze. Moreover, different countries have different door opening sizes. Therefore, we do not define or require specific dimensions of the gate.

Most preferably, the gate does not span the entire width defined by the door frame but leaves a 2.5 cm margin of clearance between the edges of the gate and the door frame. The length would need to account for a range of people's heights, including people in wheelchairs, and even people in strollers. The gate can be any thickness that is sufficiently rigid for the intended purpose. We prefer 3/16 inch or 0.476 cm. Preferably, the completed gate will be 60.96 cm by 60.96 cm by 0.476 cm thick. Optionally, the gate may be about 50-70 cm by about 50-70 cm by about 0.4-0.7 cm thick. Alternatively, the gate may be about 40-80 cm by about 40-80 cm by about 0.3-1.0 cm thick. Other dimensions are possible as long as the gate is rigid and fills enough of the open area to block respiratory droplets while still allowing the gate to hinge, and people on either side to physically exchange goods with payment.

The rectangular gate 5 has one edge to which is mounted an edge hinge. This will be called the "hinge edge" of the gate. The opposing edge will be called the "hinge-free edge." We do not identify the edges as left or right because the gate can be flipped over 180 degrees and mounted to whichever side of the door (left or right) has the hinge. As the gate is a rectangle, by definition it also has a top edge and an opposing bottom edge.

Figure 2:
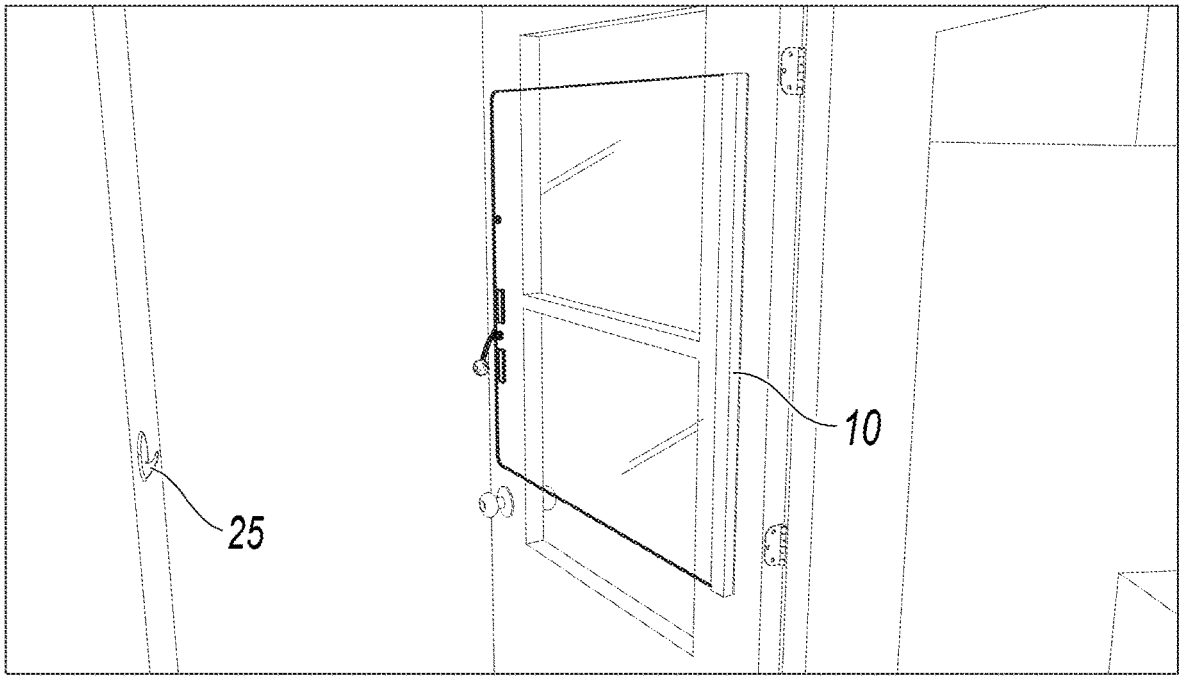
FIG. 2 is a perspective view thereof, as viewed from an interior of the building.

On the hinge edge of the gate is permanently mounted an edge hinge 10. Edge hinge 10 is mounted directly onto its corresponding door 1, parallel to and alongside the door's own hinges, facing the interior of the building. FIG. 2 shows the door's hinges mounted on the right door jamb. However, the gate can be flipped over and mounted in the same way onto a left doorjamb. In either left or right interior facing installation, edge hinge 10 allows gate 5 to swing freely forward or backward, independently of the door to which it is mounted.

Along the hinge-free side of the door frame, facing the interior, we mount a first coupling means. Preferably this is a hook such as the Command® made by 3M, as this is inexpensive and readily available. However, other first coupling means are possible, such as magnets, or cleats. To the corresponding, hinge-free, edge of the gate we mount a second coupling means. We prefer using a bungee ball assembly 20, which is durable, as well as affordable and available. Bungee ball assemblies are sold as Ball Bungees by Kotap America Ltd., (Lawrence, N.Y. 11559). Bungee ball assemblies comprise an elastic cord, known as a bungee cord. The bungee cord also has the advantage of being elastic, to accommodate holding the gate taut across different widths of door frames. We build in a margin of clearance when we cut the gate to permit the cord to stretch and hold the gate taut across the door opening. As with the first coupling means, we envision other, second, coupling means, such as magnets and also non-elastic string.

We drill holes through the gate to enable us to hitch knot a bungee ball tie assembly 20 around the hinge-free edge of the gate. Bungee ball tie assembly 20 comprises a bungee ball permanently attached to a bungee cord loop. A pair of hook and loop catch strips 15 secure the right left edge of gate 5 against the door 1 in a storage position. In this storage position, the gate remains attached to the door and swings with the door. For the interior installation, the hook and loop fastener will secure the gate plenty strongly enough.

Figure 3A:
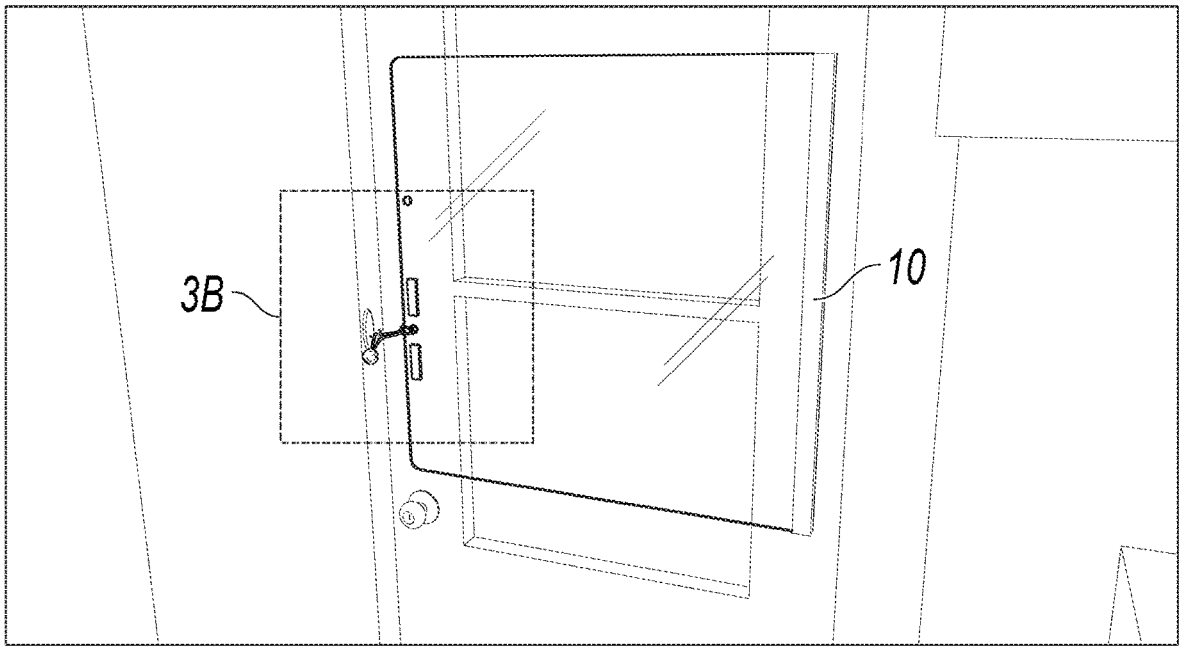
FIG. 3A is a perspective view thereof, as viewed from the interior of the building and the door closed.
Figure 3B:
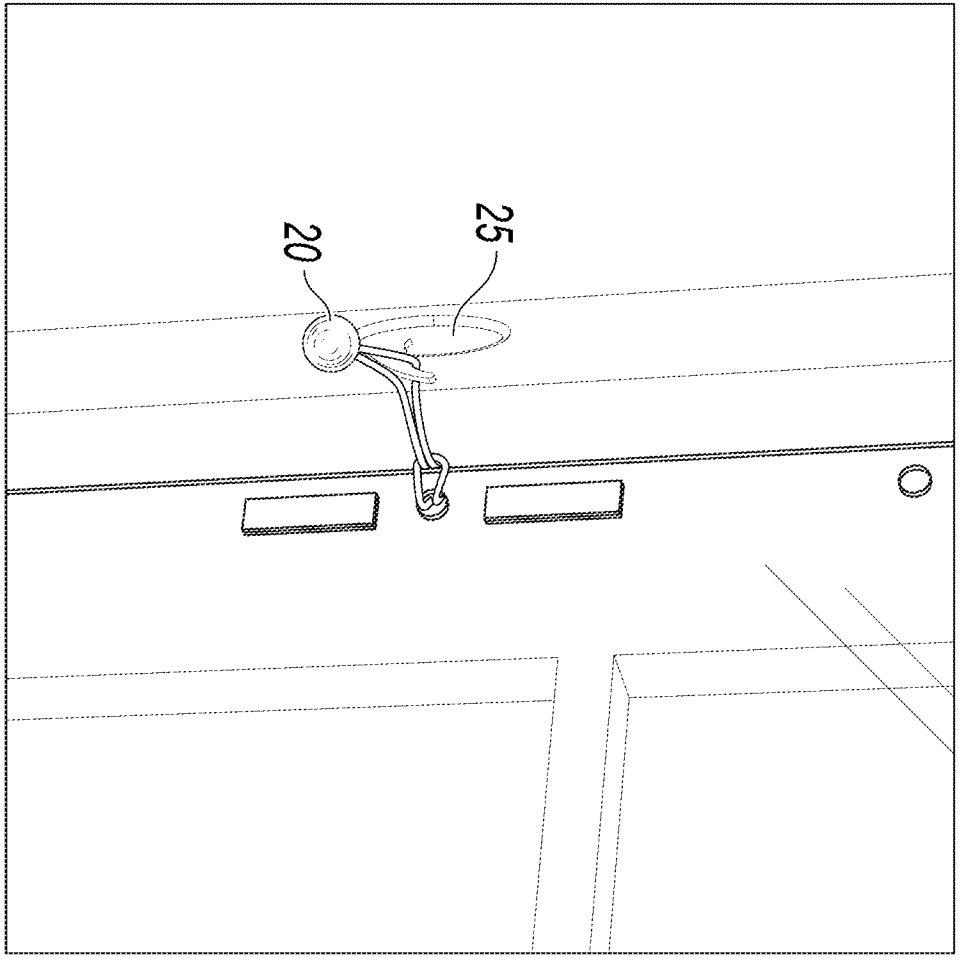
FIG. 3B is a close-up perspective view thereof, showing details of the bungee ball tie and receiving hook.
Figure 4:
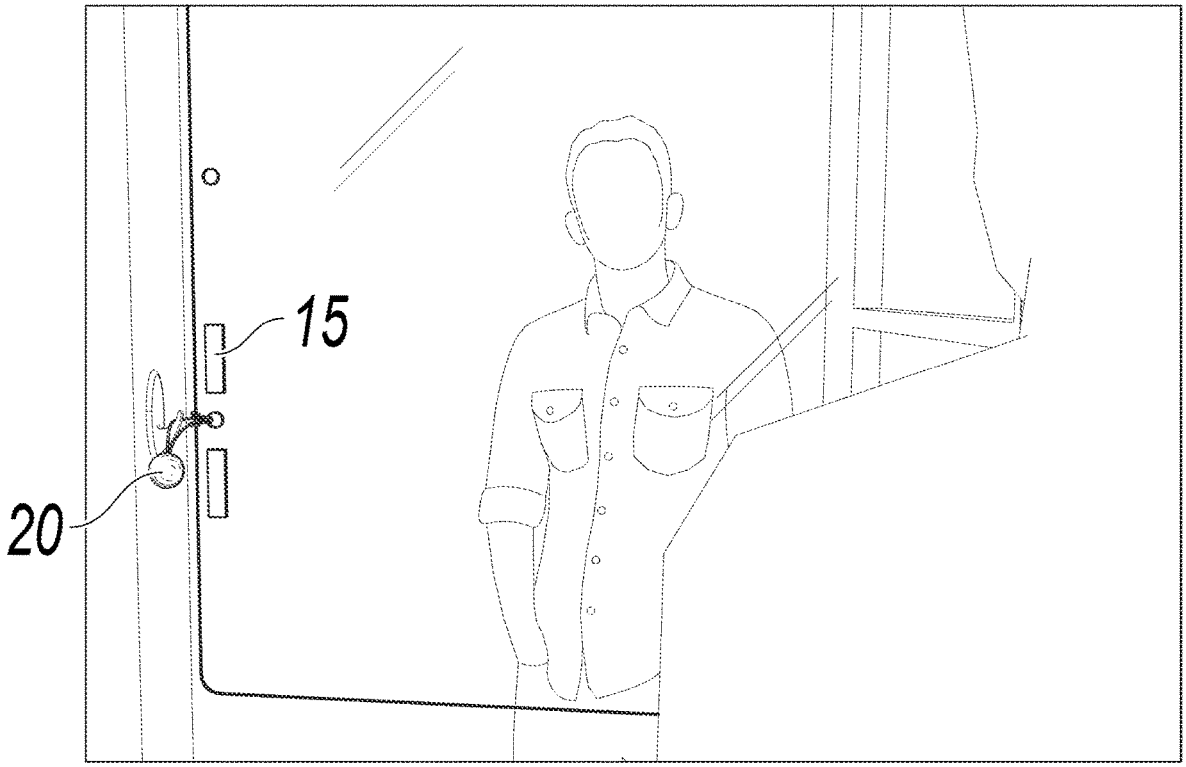
FIG. 4 is a close-up perspective view of the solid transparent health gate in an interior installation and in a deployed position, with its corresponding door open, as viewed from the interior of the building.
Figure 5:
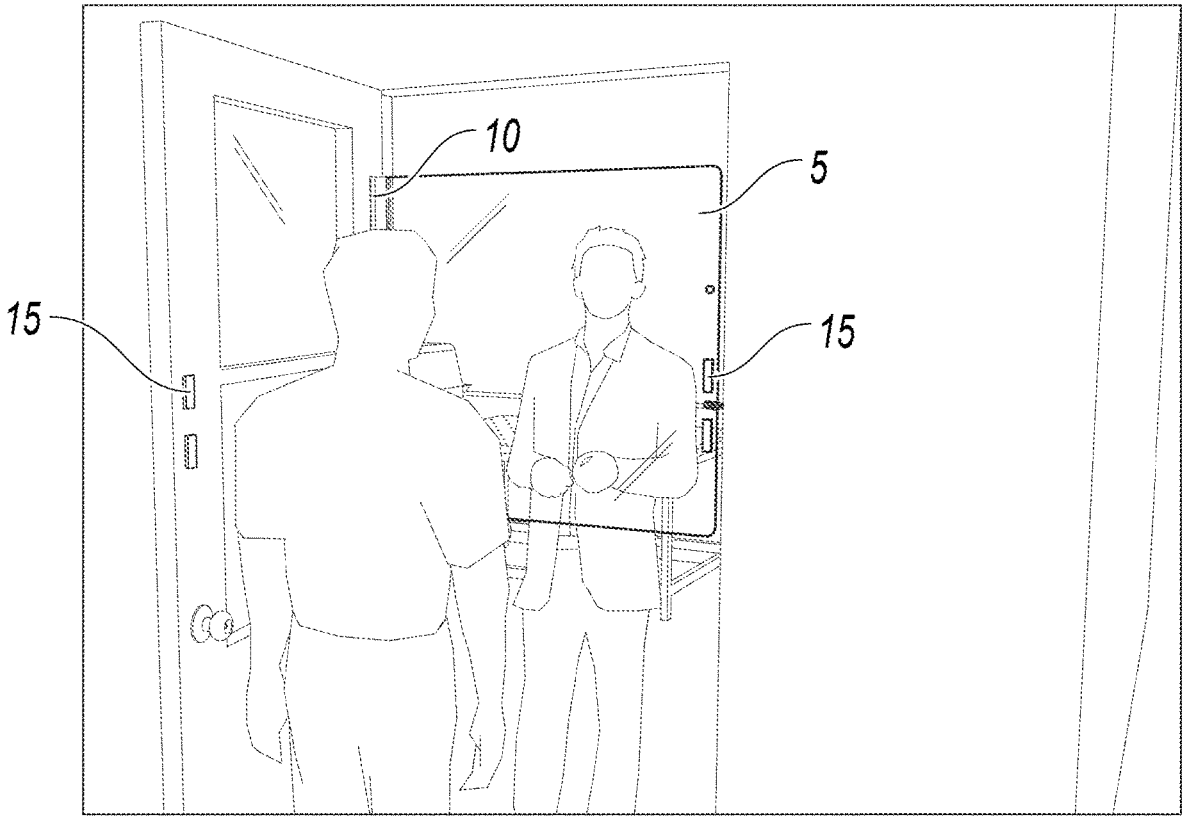
FIG. 5 is a perspective view thereof, as viewed from the exterior of the building.
Figure 6A:
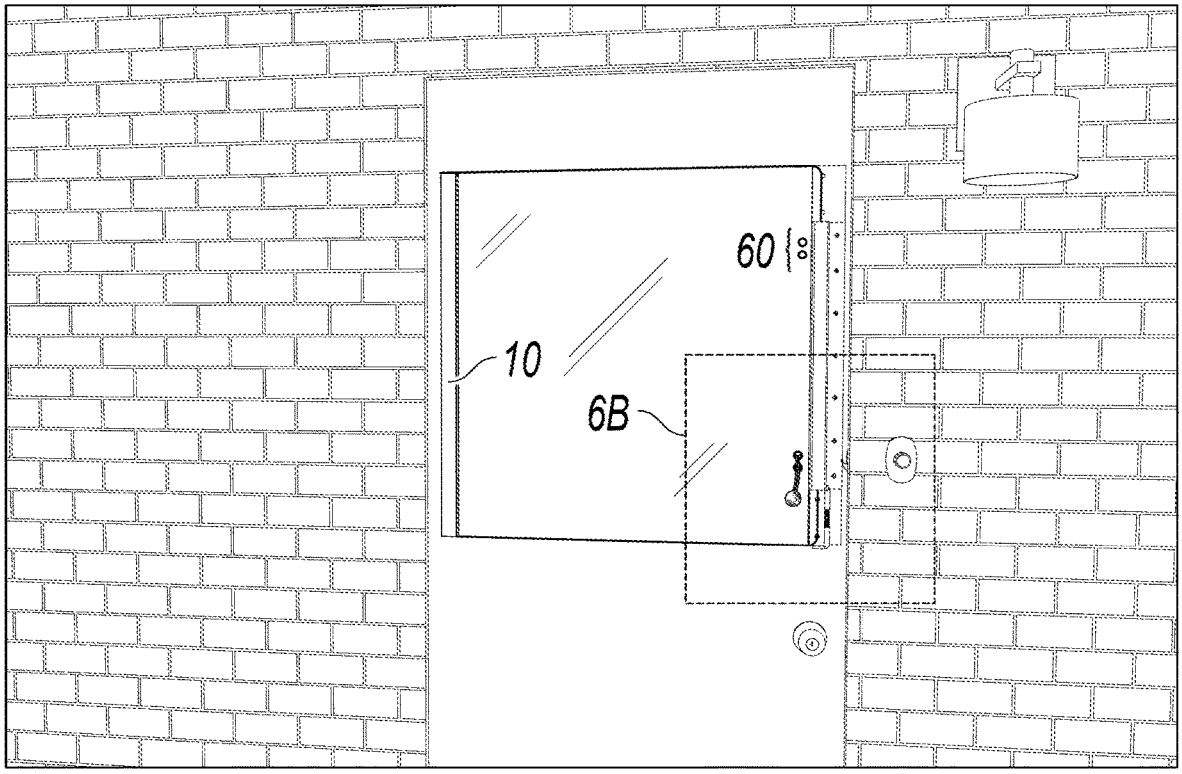
FIG. 6A is a perspective view of the solid transparent health gate in an exterior installation and in a storage position, with its corresponding door closed, as viewed from the exterior of the building.
Figure 6B:
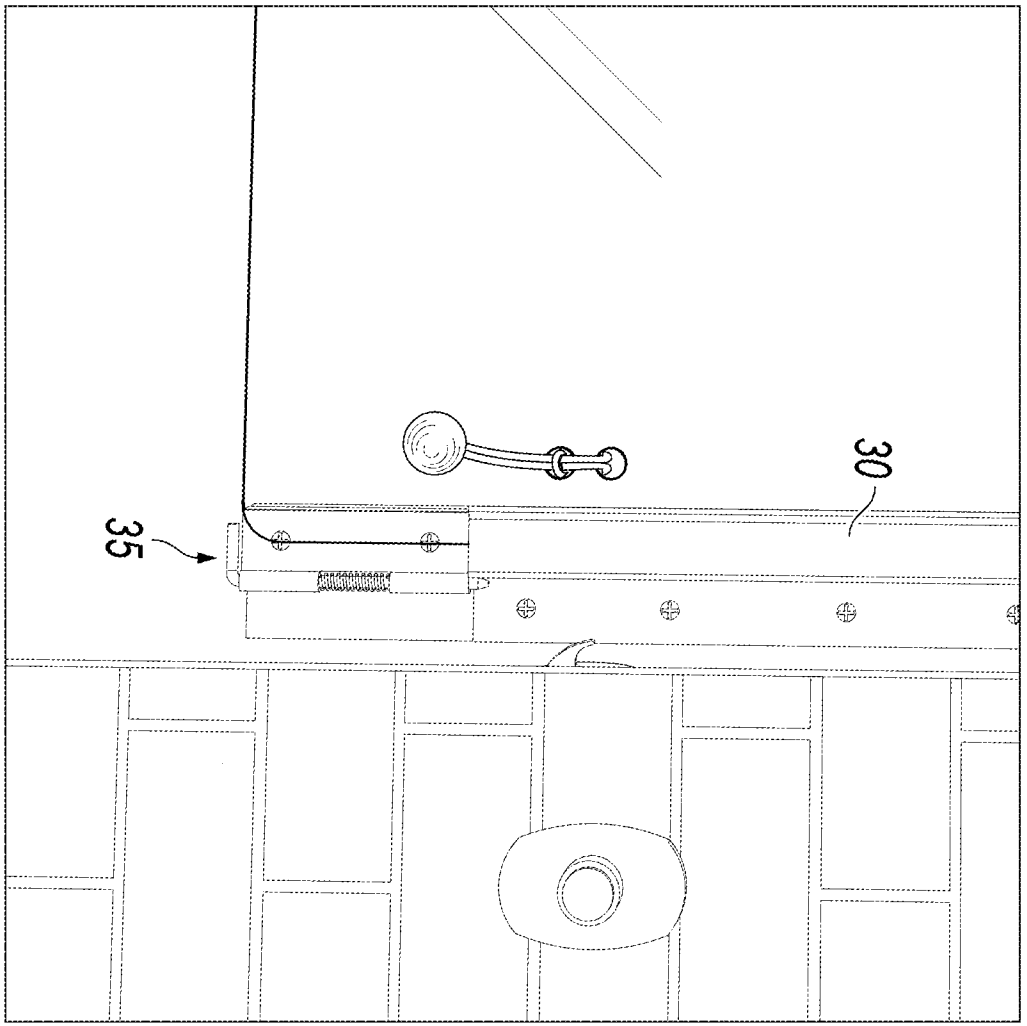
FIG. 6B is a close-up perspective view thereof, showing details of the pull-release latch assembly.
Figure 7:
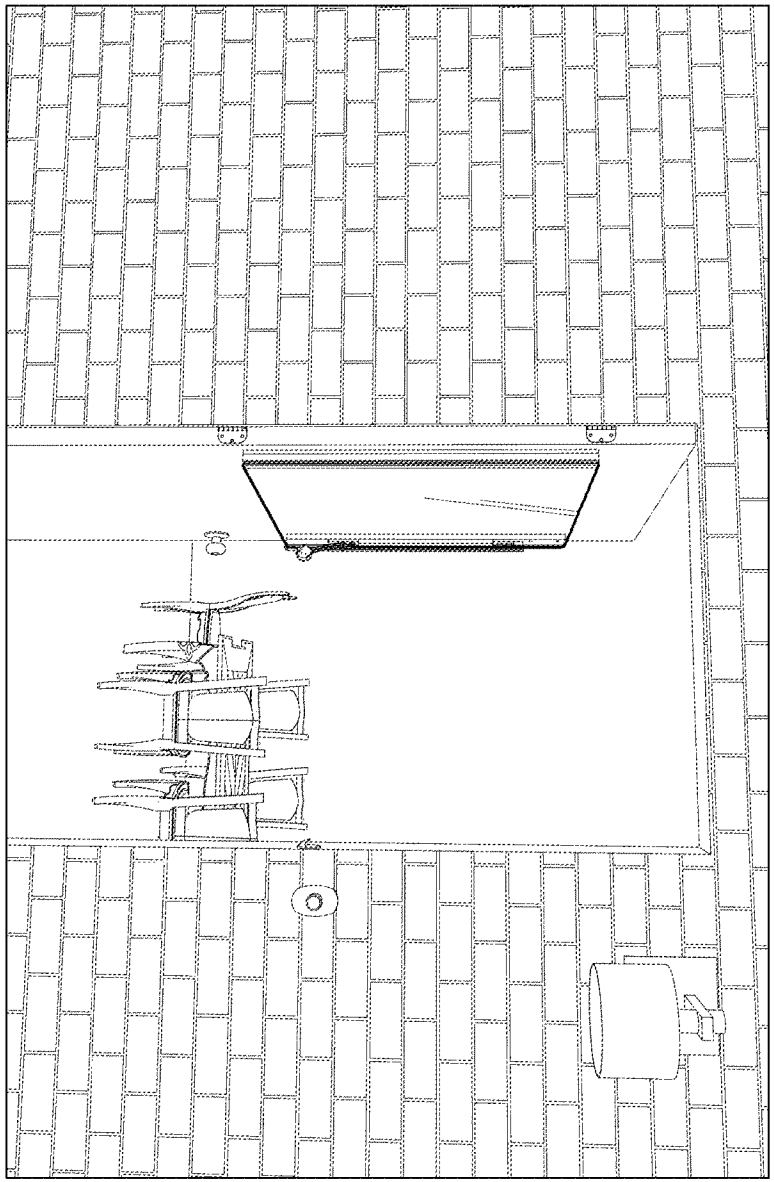
FIG. 7 is a perspective view of the solid transparent health gate in an exterior installation and in a storage position, with its corresponding door open, as viewed from the exterior of the building.
Figure 8A:
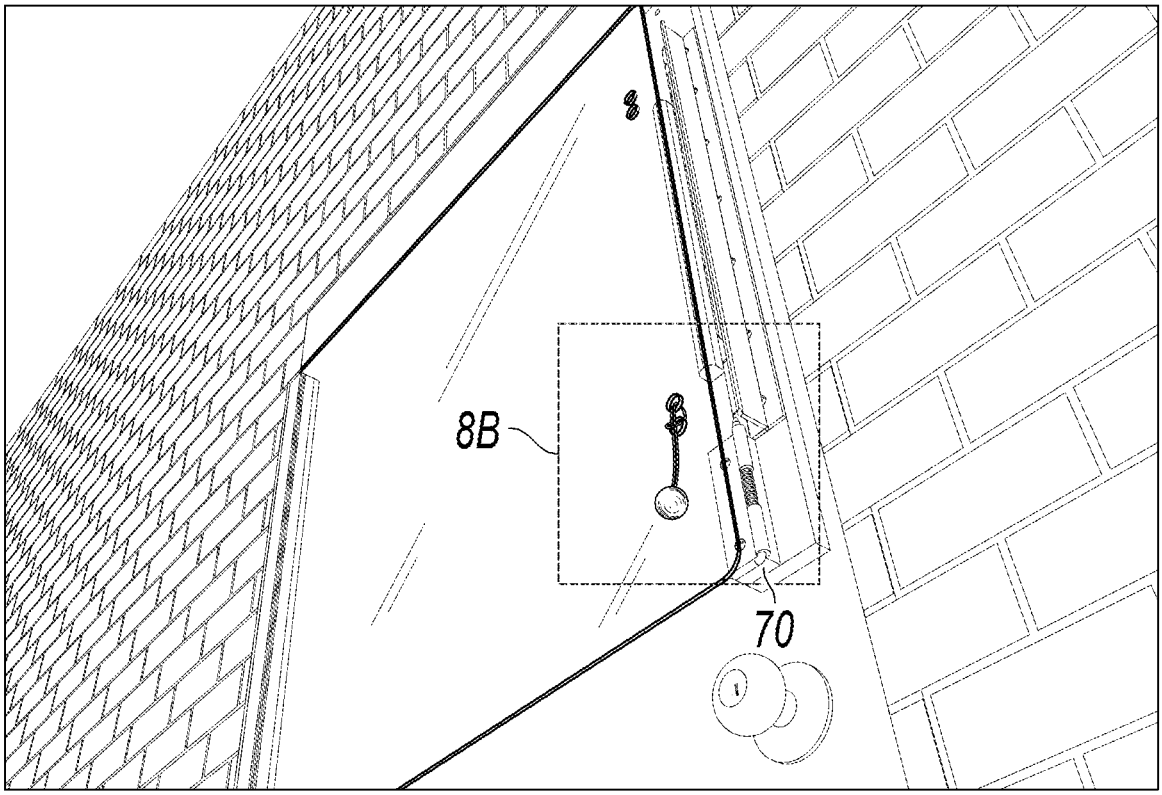
FIG. 8A is a bottom perspective view of the solid transparent health gate in an exterior installation and in a storage position, with its corresponding door closed.
Figure 8B:
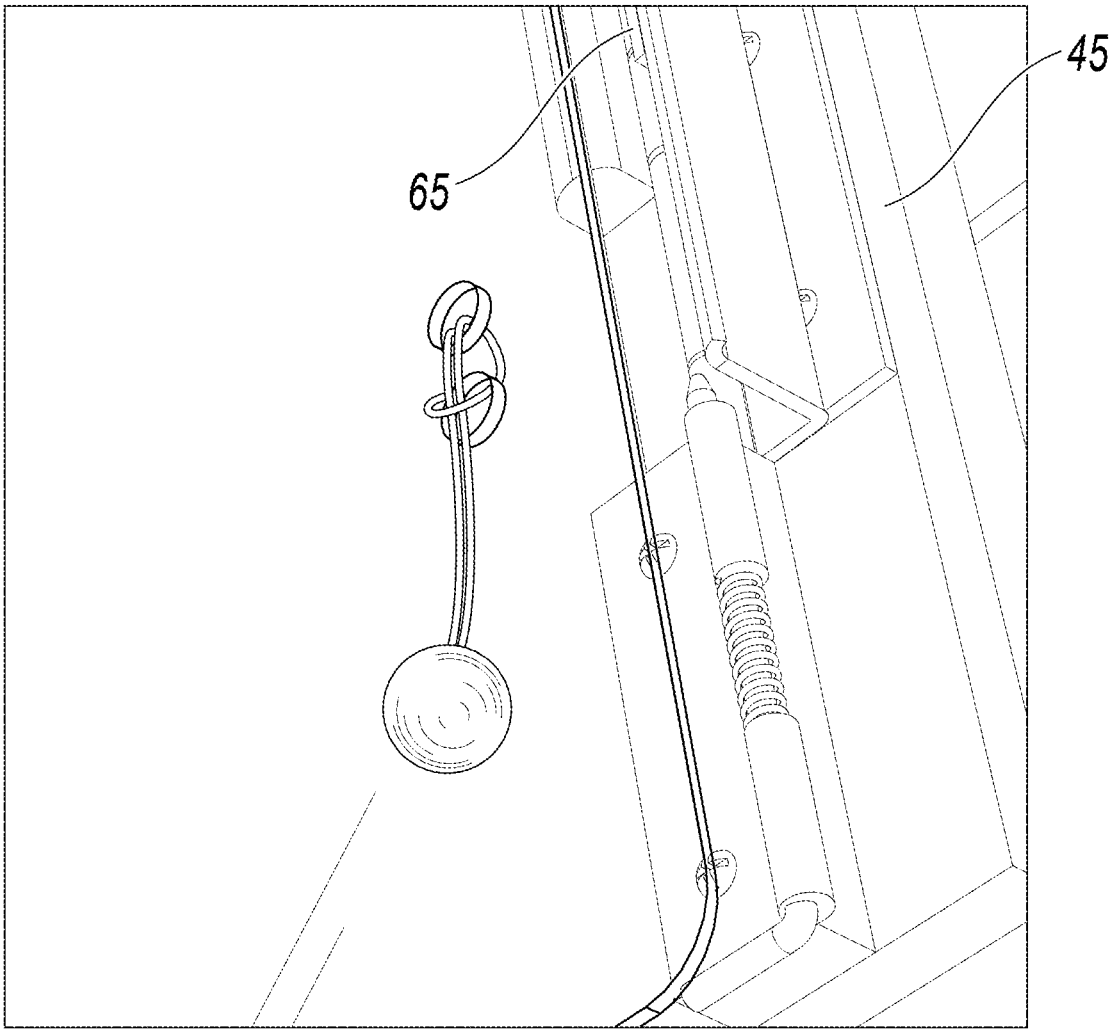
FIG. 8B is a close-up perspective view thereof, showing details of the latch mounting strip and latch cushion.

We mount a receiving hook 25 onto the hinge free side of the door frame. FIG. 2 shows receiving hook 25 mounted on the interior left door frame. To deploy the gate, a person drapes the bungee ball tie assembly 20 over receiving hook 25. FIGS. 3A and 3B show the gate deployed but still attached to its door. To open the door with the gate deployed, a person separates the hook and loop fasteners and pulls the door toward him. This is shown in FIG. 4. FIG. 5 shows two people on either side of the gate, with the gate deployed and the door open. The people can see and hear each other, exchange goods and payment below the bottom edge of the gate. Gate 5 blocks any respiratory droplets from passing therebetween.

When we mount the gate facing an exterior space, we have to assume hook and loop fasteners are not strong enough to withstand high winds. We therefore add an extra, more robust, means of securing the gate to the door while being stored. We add a latch assembly to the exterior installation to ensure the gate is not accidentally blown open by gusts of wind. Please see FIG. 6A for the overview. As in the interior installation, the gate has an edge hinge 10 mounted to a one edge of the gate ("the hinge edge"). In this example, the hinges are on the left side as you stand exterior and look interiorly. As in the interior installation, we mount the gate onto the door, parallel to and alongside the door's own hinges (not shown). The gate has the same bungee ball tie assembly on the opposing, hinge-free edge. In the exterior installation, we mount onto the opposing, hinge-free side of the door, parallel to the length of the door frame, a gate securing means. This is in addition to the hook and loop fastener. Preferably the gate securing means is a latch assembly that selectively folds down to sandwich the unhinged right edge of the gate therebetween and against the door, and folds up to release the gate therebeneath. However, as with other specifications, it is possible to use other gate securing means that are still within the spirit and letter of this disclosure.

Figure 9A:
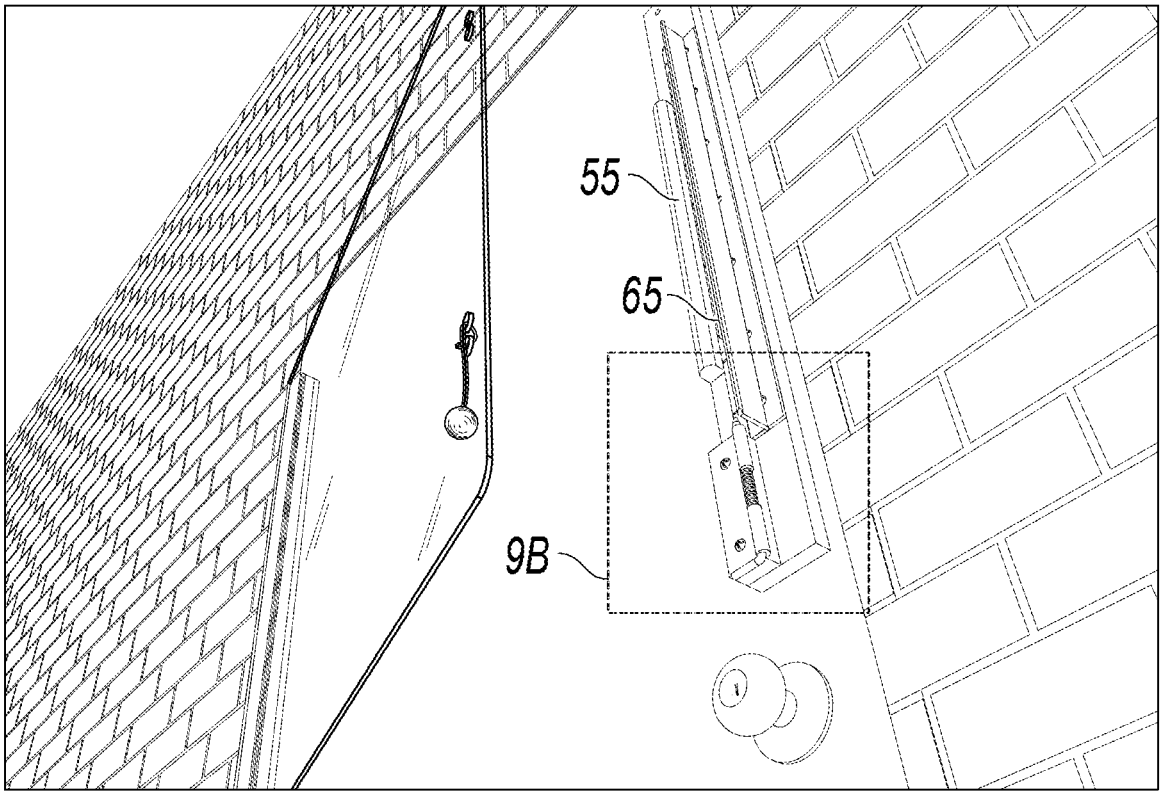
FIG. 9A is a perspective view of the solid transparent health gate in an exterior installation, in a partially deployed position, with the hinge latch up.
Figure 9B:
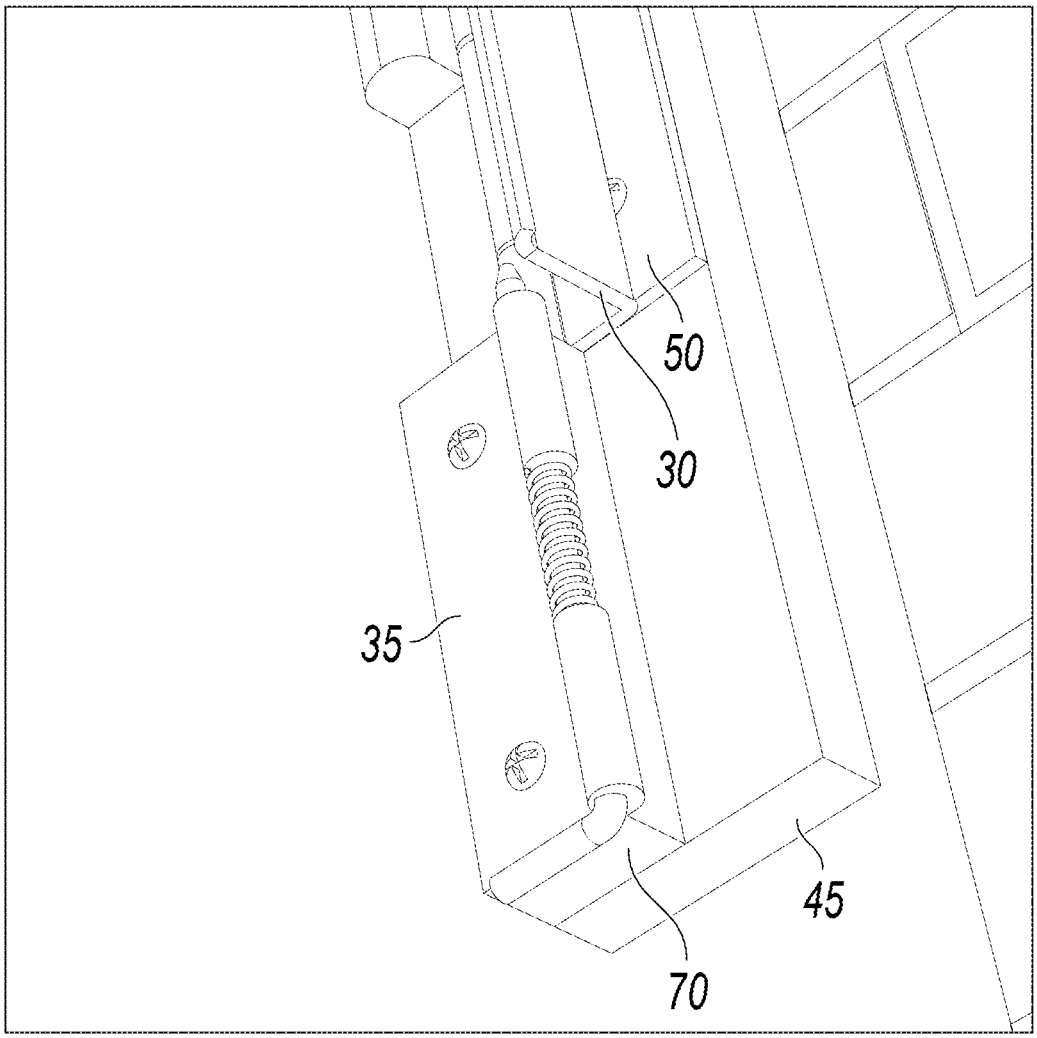
FIG. 9B is a close-up perspective view thereof, showing details of the latch hinge, pull-release latch assembly, latch mounting strip, hinge mounting strip and latch mounting block without the gate in front of them.
Figure 10A:
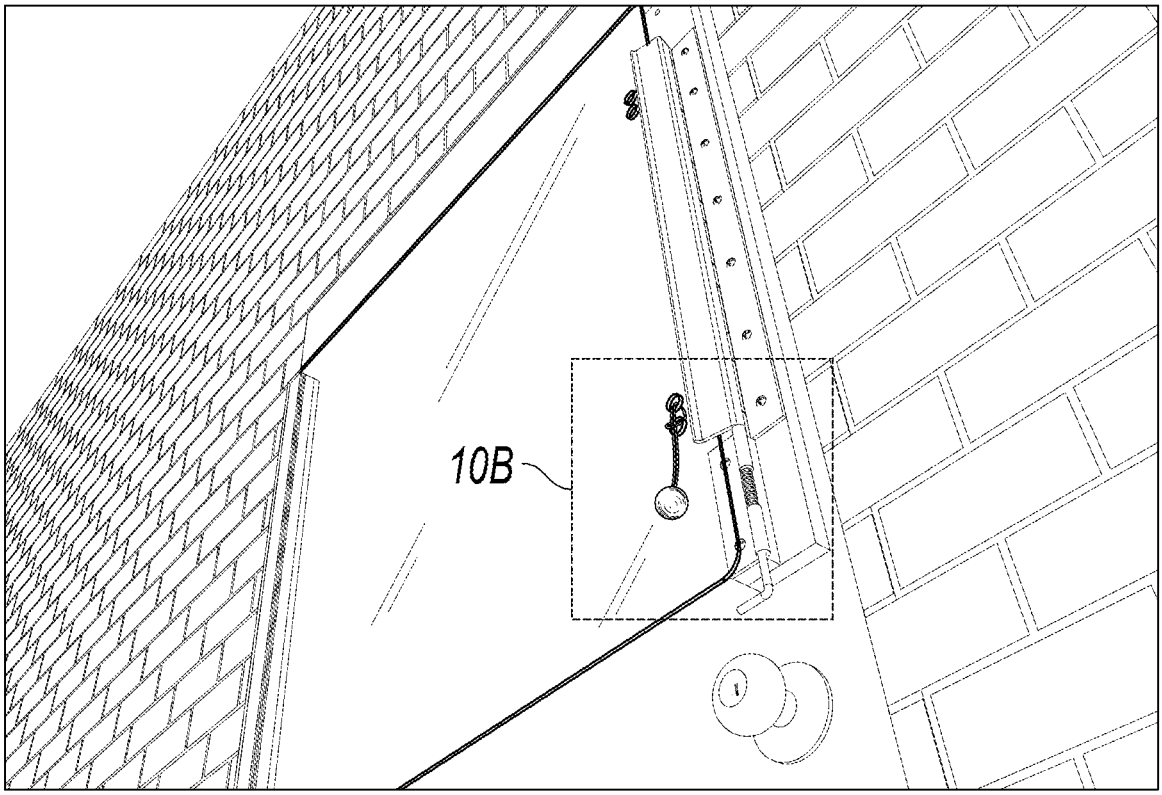
FIG. 10A is a perspective view of the solid transparent health gate in an exterior installation, in a deployed position, with its corresponding door closed, with the hinge latch down.
Figure 10B:
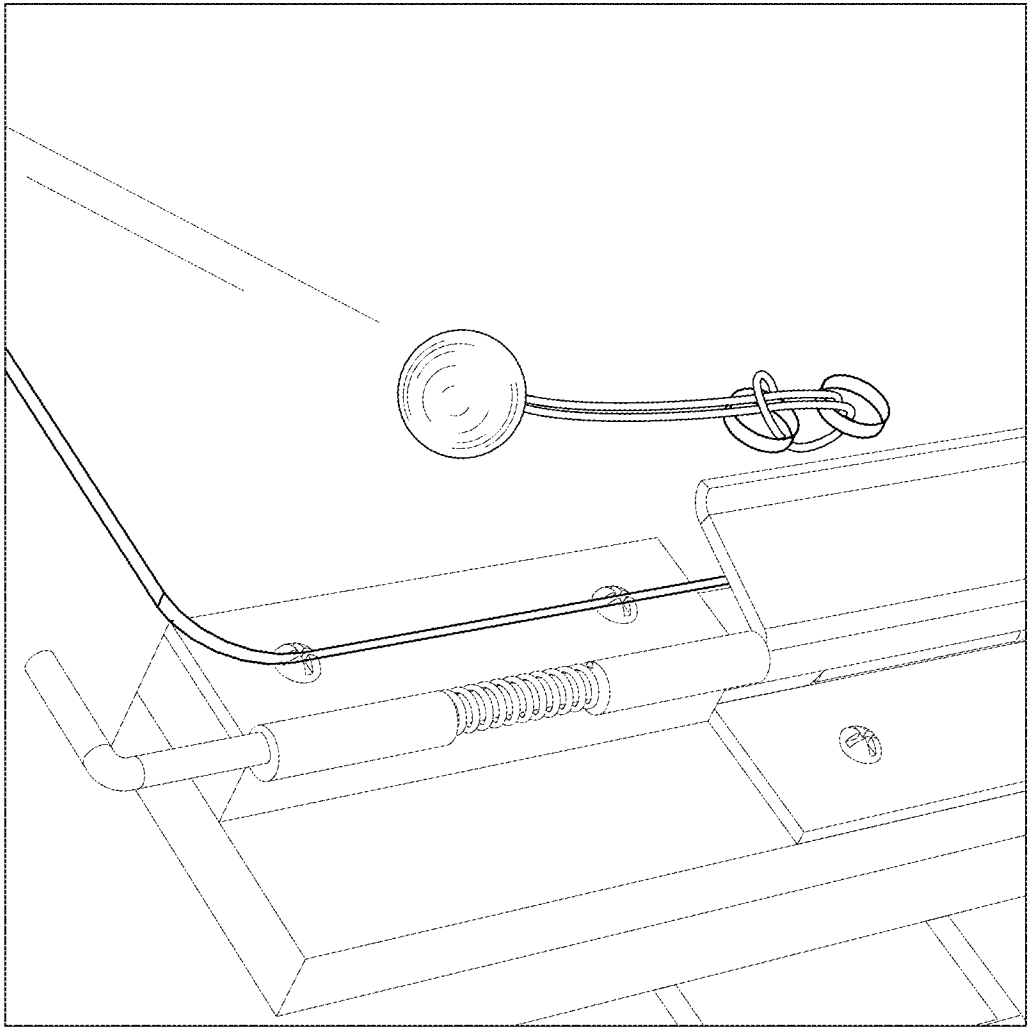
FIG. 10B is a close-up perspective view thereof, showing details of the hinge latch.
Figure 11A:
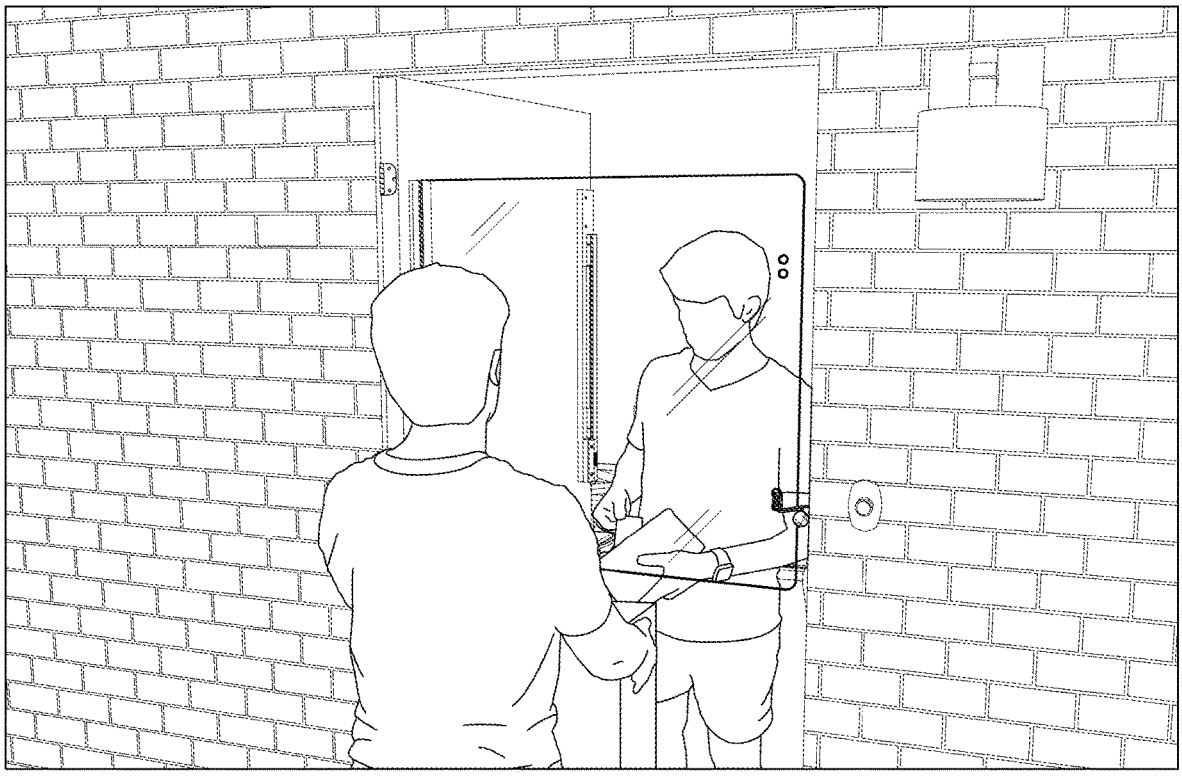
FIG. 11A is a perspective view of the solid transparent health gate in an exterior installation, in a deployed position, with its corresponding door open.

The latch assembly comprises a latch hinge 30 resting on a support assembly comprising latch mounting strip 45, latch mounting block 70, pull-release latch assembly 35 and hinge mounting strip 50 (FIG. 9B). Latch hinge 30 rests on the support assembly and can be folded up to release the gate (FIGS. 8B and 9A) or down to enclose and sandwich the gate therebetween (FIGS. 10A and 10B). Bungee ball tie assembly 20 hangs free while the gate is in a storage position and is not enclosed by the latch. When the gate is deployed in the exterior installation (FIG. 11A), note the bungee cord pulled to the right. Receiving hook 25 is mounted on the right interior door jamb (as looking inward) as in the interior installation, although the hook is not visible in FIG. 11A.

Although embodiments and examples of the invention have been shown and described, it is to be understood that various modifications, substitutions, and rearrangements of parts, components, steps, as well as other uses, shapes, construction, and design of this system can be made by those skilled in the art without departing from the novel spirit and scope of this invention.

We claim:

1. A method of blocking the transmission of airborne pathogens between people standing on either side of a door separating an interior space from an exterior space, the door having a hinge mounted thereonto, the door hinged to and hanging within a door frame, this door and its frame having a hinge side and an opposing hinge-free side, the door frame having a length and a width, the method comprising the steps of:

a. mounting an edge hinge along substantially an entire length of a hinge edge of a rectangular, rigid, and transparent gate, the gate also having an opposing hinge-free edge;

b. mounting the edge hinge to the hinge side of the door, parallel to the hinge holding the door to the door frame and facing the interior space;

c. mounting a receiving hook on the door frame facing the interior space;

d. installing a bungee ball tie assembly along the hinge-free edge of the gate;

e. coupling the receiving hook to the bungee ball tie assembly, thereby retaining the gate to fill the width defined by the door frame while leaving an at least 2.5 cm margin between the edges of the gate and the corresponding sides of the door frame; and f. opening the door, such that the gate hingedly opens relative to the door.

2. A method of blocking the transmission of airborne pathogens between people standing on either side of a door separating an interior space from an exterior space, this door having a hinge mounted thereonto, the door hinged to and hanging within a door frame, the door and its frame having a hinge side and an opposing hinge-free side, the method comprising the steps of:

g. mounting an edge hinge along substantially an entire length of a hinge edge of a rectangular, rigid, and transparent gate, the gate also having an opposing hinge-free edge;

h. mounting the edge hinge to the hinge side of the door, parallel to the hinge holding the door to the door frame and facing the exterior space;

i. mounting a receiving hook on the door frame facing the interior space;

j. installing a bungee ball tie assembly along the hinge-free edge of the gate;

k. mounting a gate securing means to the hinge-free side of the door and facing the exterior space;

l. releasing the gate from beneath the gate securing means;

m. coupling the receiving hook to the bungee ball tie assembly, thereby retaining the gate so that it substantially fills the area defined by the door frame; and n. opening the door, such that the gate hingedly opens relative to the door.

3. The method of claim 2, wherein the releasing step comprises folding up a latch assembly which is mounted parallel to the hinge and which had been securing the door against the door frame.

* * * * *